US005492642A

United States Patent [19]

Mulvihill et al.

[11] Patent Number: 5,492,642

[45] Date of Patent: Feb. 20, 1996

[54] TOP OF RAIL LUBRICATING METHOD AND COMPOSITION

[75] Inventors: Mark A. Mulvihill, Beaumont; Arnold C. Witte, Jr., Port Neches, both of Tex.

[73] Assignee: Texaco Inc., White Plains, N.Y.

[21] Appl. No.: 277,807

[22] Filed: Jul. 20, 1994

[51] Int. Cl.[6] ..... C10M 105/18

[52] U.S. Cl. ..... 252/52 A; 252/52 R

[58] Field of Search ..... 252/52 R, 52 A, 252/73, 49.3; C10M 105/18, 129/16

[56] References Cited

U.S. PATENT DOCUMENTS

| | | | |
|---|---|---|---|
| 2,462,694 | 2/1949 | Walker | 252/75 |
| 2,602,780 | 7/1952 | Zisman | 252/73 |
| 3,346,501 | 10/1967 | Boehmer | 252/73 |
| 4,390,440 | 6/1983 | Schwartz et al. | 252/76 |
| 4,493,780 | 1/1985 | Schwartz et al. | 252/73 |
| 5,158,694 | 10/1992 | Waynick | 252/18 |
| 5,213,697 | 5/1993 | Vinci et al. | 252/41 |

*Primary Examiner*—Prince Willis, Jr.
*Assistant Examiner*—Cephia D. Toomer
*Attorney, Agent, or Firm*—James L. Bailey; Kenneth R. Priem; Richard A. Morgan

[57] ABSTRACT

An aqueous top of rail lubricant comprises a synthetic lubricant, a synthetic thickener, propylene glycol and ethanol. The lubricating composition is consumed in 5 to 15 minutes in the heat generated by a passing train. The lubricant is environmentally innocuous.

4 Claims, No Drawings

TOP OF RAIL LUBRICATING METHOD AND COMPOSITION

1. Field Of The Invention

The invention relates to a railroad lubricant. The invention is also a method of lubricating the top of a rail. The method relies on a lubricating composition comprising an environmentally innocuous synthetic oil and thickener in volatilizing solvents.

2. Description Of The Related Art

In railroad lubrication, the top of the rail is lubricated to reduce lateral creep of a wheel which causes increased wheel flange-rail interaction. Wheel flange-rail interaction results in wear and additional fuel use and in the extreme is a contributing factor in derailment.

One of the benefits derived from a good top of the rail lubricants is that maximum safe speeds at which a train can run with worn equipment, termed Hunting Speed, is increased. Increased train speed in a rail network can result in improved business operations such as meeting schedules and improved equipment utilization.

A top of the rail lubricant is applied after the locomotive has passed, providing lubrication for the rail car wheels. It is desirable that a top of the rail lubricant not persist on the rail after the train has passed. A persistent lubricant would reduce traction for the next locomotive passing on the track.

There is a need in the art for the consumable top of the rail lubricant which is environmentally innocuous.

SUMMARY OF THE INVENTION

A method has been found for lubricating the top of a rail. A lubricating composition is applied to the top of the rail in an amount to wet the rail in the heat generated by the passing of one train.

The aqueous composition comprises a synthetic lubricant, a synthetic thickener and a volatilizable solvent.

The synthetic lubricant is a first polyoxyalkylene glycol comprising a linear copolymer of 70 to 80 wt% ethylene oxide and the balance propylene oxide. It has a molecular weight of 3900 to 4600. This first polyoxyalkylene glycol comprises 10 to 30 wt%, preferably 14 to 24 wt% of the composition.

The synthetic thickener is a second polyoxyalkylene glycol comprising a linear copolymer of 70 to 80 wt% ethylene oxide and the balance propylene oxide. It has a molecular weight of 8000 to 12,000. This second polyoxyalkylene glycol comprises 0.1 to 3 wt%, preferably 0.5 to 1 wt% of the composition.

The volatilizable solvent is a blend of propylene glycol and an alcohol selected from the group consisting of methanol, ethanol and mixtures thereof. The alcohol comprises 2 to 18 wt%, preferably 8 to 12 wt% of the composition. Propylene glycol comprises 15 to 30 wt% preferably 20 to 25 wt% of the composition.

The composition is consumable, i.e., vaporizable. It evaporates from the rail with the heat generated by the passing of a train. The composition flows at temperatures down to −30° F. (−34.4° C.) and below.

DETAILED DESCRIPTION OF THE INVENTION

The lubricating method relies on an aqueous mixture of two compatible polyoxyalkylene glycols. Both are represented by the general formula:

$$HO-(CH_2\underset{\underset{R}{|}}{C}HO)_n-H$$

wherein for each monomer, R is independently hydrogen or methyl, and n is defined by the molecular weight of the glycol.

The first polyoxyalkylene glycol comprises 10 wt% to 30 wt%, preferably 14 wt% to 24 wt% of the composition. The and 20% to 30% propylene oxide. It has an average molecular weight of 3900 to 4600. A commercially available sample of TEXOX® WL-5000 had a neat viscosity of 5000 Saybolt Universal Seconds (SUS) at 100° F. (37.8° C.)

TEXOX® WL-5000 had the chemical structure:

$$H(OCH_2CH_2)_x(OCH(CH_3)CH_2)_y(OCH_2CH_2)_xOH$$

wherein: x is at least 1 and the sum of x+y yields a copolymer having a molecular weight of 4365.

The second polyoxyalkylene glycol is a thickener comprising 0.1 wt% to 3.0 wt%, preferably 0.5 wt% to 1 wt% of the composition. This second polyoxyalkylene glycol is a linear copolymer of 70% to 80%, typically 75% ethylene oxide and 20% to 30% propylene oxide. It has an average molecular weight of 8000 to 12,000, typically 10,000 to 11,000. Ethanol is the preferred alcohol because it has less toxicity in handling.

A sample of UCON® 75-H-90000 had an average molecular weight of approximately 10,300 and a neat viscosity of approximately 90,000 Saybolt Universal Seconds (SUS) at 100° F. (37.8° C.). The only side chains on the essentially linear copolymer are the methyl groups of the propylene oxide.

The aqueous mixture will typically comprise a rust inhibitor. Gateway ADDCO CP-105 brand, a cathodic amine borate rust inhibitor was used in Example 1. Other suitable cathodic rust inhibitors include: phosphates, polyphosphates, sodium benzoate, quaternary amines, borax, amine borates, sodium borates, sodium molybdate, alkali metal nitrates, alkyl carboxylates, benzo tolyl triazoles, sulfonates and zinc salts. Suitable organic rust inhibitors include: morpholine amines, ammonia, ethylenediamines, hydrazine, immidazolines, formamide, and alkanolamines. Anodic rust and corrosion passivators include: carbonates, bicarbonates, sodium silicates, metasilicates, sodium chromates, calcium hydroxide, calcium bicarbonates, sodium nitrate, and sodium chromate.

The lubricating compositions are formulated by methods well known in the art. The formulation may be carried out continuously. In the alternative, the compositions can be formulated in a semiworks by hand. The two polyoxyalkylene glycol substituents are weighed out individually in a stainless steel pail on a scale. The less viscous polyoxyalkylene glycol and deionized water are added to a steam jacketed stainless steel kettle at ambient temperature to about 150° F. (65.5° C.), with stirring. Additives such as a rust inhibitor and biocide may then be added. When a homogeneous mixture is achieved, the polyoxyalkylene glycol thickener is added in aliquots with continuous stirring to maintain homogeneity. The result is the final lubricating composition. This composition is cooled to room temperature, sampled, canned and labeled.

At the point of use, a locomotive mounted applicator is drained, flushed and then refilled with the lubricating composition of the invention. The composition is a consumable lubricant which is the term used in the art for a lubricant which evaporates in the heat generated by railroad wheels passing over the rail. A consumable lubricant is formulated to provide consumption by the passage of a train. This typically occurs in 5 to 15 minutes.

Complete consumption of the lubricant allows the next locomotive to pass over the rail without loss of traction or loss of the electric communication link through the rail. A top of the rail lubricant is applied after the locomotive has passed, providing lubrication for only the rail car wheels, not the locomotive traction wheels.

This invention is shown by way of Example.

EXAMPLE 1 AND COMPARATIVE EXAMPLE 2

Four pounds of the lubricating composition of the invention was formulated by combining the substituents and heating with stirring for 30 minutes at 77° F. (25° C.). This lubricating composition had the following ingredients:

| | EXAMPLE 1 |
|---|---|
| Polyoxyalkylene glycol[1] | 19.30wt% |
| Thickener[2] | 0.70wt% |
| Propylene glycol | 21.70wt% |
| Ethanol | 10.00wt% |
| Deionized water | 47.80wt% |
| Rust inhibitor[3] | 0.50wt% |

[1] TEXOX ® 5000, Molecular Weight (MW) 4365
[2] UCON ® 75-H-90000, MW 10,300
[3] Gateway ADDCO CP-105 brand The lubricating composition had the following physical properties compared to a naphthenic 55 SUS base oil (N55 Pale Oil).

| | EXAMPLE 1 | COMPARATIVE EXAMPLE 2 |
|---|---|---|
| Appearance | Bright, Clear | Bright, Clear |
| vis. @ 40° C. | 15.4 cSt | 10.0 cSt |
| vis. @ 100° C. | — | 2.5 cSt |
| Pour Point | −45° F. | −50° F. |
| Chip Rust Test | Pass | — |
| Flash Point, COC | — | 315° F. |

Flash Point, ASTM D-92-85
Pour Point, ASTM D-97-87

In the Chip Rust Test, approximately 15 ml portions of clean, dry cast iron chips were soaked in the composition. The fluid was drained and the chips were spread evenly over the bottom of a 100 mm diameter Petri dish. After drying for hours, the chips were rated for rust. Rust on up to 10 chips was a pass. The rusting of 11 or more chips was a failure of the test.

Both lubricants were tested in the Illinois Institute of Technology (IIT) Wheel Rail Simulation rig. This test rig comprises a ¼ scale wheel and rail for rail lubrication testing. The Example 1 lubricant was consumed in 10 minutes. Comparative Example 2 lubricant persisted for greater than 220 minutes.

COMPARATIVE EXAMPLES 3 AND 4

Two, 0.5 gallon batches were formulated by combining the ingredients at 100° F. (37.8° C.) and stirring for 20 minutes.

| | EXAMPLE 3 | EXAMPLE 4 |
|---|---|---|
| Polyoxyalkylene glycol[1] | 19.30wt% | 19.30wt% |
| Thickener[2] | 0.70 | 0.70 |

-continued

| | EXAMPLE 3 | EXAMPLE 4 |
|---|---|---|
| Propylene glycol | 40.00 | 10.00 |
| Deionized water | 40.00 | 70.00 |

[1] TEXOX ® 5000, MW 4365
[2] UCON ® 75-H-90000, MW 10,300

The batches were sampled and tested for physical properties.

| | EXAMPLE 3 | EXAMPLE 4 |
|---|---|---|
| Appearance | Bright, Clear | Bright, Clear |
| vis. @ 40° C. | 23.4 cSt | 0.59 cSt |
| vis. @ 100° C. | 4.53 cSt | — |
| Pour Point | −47° F. | +15° C. |

Both lubricants were tested in the Illinois Institute of Technology (IIT) Wheel Rail Simulation Rig.

These two examples demonstrate the balance required between water and propylene glycol to produce an adequate viscosity at 40° C. In Example 3, both viscosity at 40° C. (23.41 cSt) and pour point (−47° F.) were adequate. However, the Example 3 lubricant persisted too long under load on the rail.

The Example 4 lubricant had too low a viscosity and too high a pour point for top of rail use.

EXAMPLES 5, 6 AND 7

Three, 0.25 gallon batches of the lubricating composition were formulated by combining the ingredients at 150° F. (65.5° C.) and stirring for 30 minutes.

| | EXAMPLE 5 | EXAMPLE 6 | EXAMPLE 7 |
|---|---|---|---|
| Polyoxyalkylene | 19.30wt% | 19.30wt% | 19.30wt% |
| glycol[1] | 0.70 | 0.70 | 0.70 |
| Thickener[2] | 21.70 | 16.70 | 11.70 |
| Propylene glycol | 5.00 | 10.00 | 15.00 |
| Ethanol | 53.30 | 53.30 | 53.30 |
| Deionized water | | | |

[1] TEXOX ® 5000, MW 4365
[2] UCON ® 75-H-90000, MW 10,300

The batches were sampled and tested for physical properties.

| | EXAMPLE 5 | EXAMPLE 6 | EXAMPLE 7 |
|---|---|---|---|
| Appearance | Bright, Clear | Bright, Clear | Bright, Clear |
| vis. @ 40° C. | 14.2 cSt | 13.4 cSt | 12.5 cSt |
| Pour Point | −30° F. | −35° F. | −35° F. |

The lubricant of Example 5 was tested in the Illinois Institute of Technology (IIT) Wheel Rail Simulation Rig. The Example 5 lubricant was consumed in 7 minutes. Because of the similarity in composition and viscosity @ 40° C., it was assumed Examples 6 and 7 lubricants would have the same consumption rate.

These examples demonstrate the effect ethanol has on physical properties of the composition.

EXAMPLES 8, 9 AND 10

Three, 0.25 gallon batches of the lubricating composition were formulated by combining the ingredients at 150° F. (65.5° C.) and stirring for 30 minutes.

| | EXAMPLE 8 | EXAMPLE 9 | EXAMPLE 10 |
|---|---|---|---|
| Polyoxyalkylene glycol[1] | 19.30wt% | 19.30wt% | 19.30wt% |
| Thickener[2] | 0.70 | 0.70 | 0.70 |
| Propylene glycol | 21.70 | 16.70 | 11.70 |
| Methanol | 5.00 | 10.00 | 15.00 |
| Deionized water | 53.30 | 53.30 | 53.30 |

[1]TEXOX ® 5000, MW 4265
[2]UCON ® 75-H-90000, MW 10,300

The batches were sampled and tested for physical properties.

| | EXAMPLE 8 | EXAMPLE 9 | EXAMPLE 10 |
|---|---|---|---|
| Appearance | Bright, Clear | Bright, Clear | Bright, Clear |
| vis. @ 40° C. | 13.5 cSt | 12.0 cSt | 11.0 cSt |
| Pour Point | −30° F. | −30° F. | — |

The lubricant of Example 8 was tested in the Illinois Institute of Technology (IIT) Wheel Rail Simulation Rig. The Example 8 lubricant was consumed in 7 minutes. Because of the similarity in composition and viscosity @ 40° C., it was assumed Examples 9 and 10 would have the same consumption rate.

These examples demonstrate the effect methanol has on physical properties of the composition.

EXAMPLES 11 AND 12

Two, 4 lb. batches of the lubricating composition were formulated. Propylene glycol and methyl paraben (ethyl paraben) were combined with heating and stirring until the mixture was homogeneous at 130° F. to 140° F. Propylene glycol, deionized water and thickener were then added. Finally methanol was added. The composition was stirred for 30 minutes at 130° F.

| | EXAMPLE 11 | EXAMPLE 12 |
|---|---|---|
| Polyoxyalkylene glycol[1] | 19.30wt% | 19.30wt% |
| Thickener[2] | 0.70 | 0.70 |
| Propylene glycol | 21.70 | 21.70 |
| Methanol | 5.00 | 5.00 |
| Deionized water | 52.90 | 52.90 |
| Methyl Paraben | 0.40 | — |
| Ethyl Paraben | — | 0.40 |

[1]TEXOX ® 5000, MW 4365
[2]UCON ® 75-H-90000, MW 10,300

The batches were sampled and tested for physical properties.

| | EXAMPLE 11 | EXAMPLE 12 |
|---|---|---|
| Appearance | Bright, Clear | Bright, Clear |
| vis. @ 40° C. | 14.1 cSt | 14.4 cSt |
| Pour Point | −20° F. | −25° C. |
| Chip Rust Test, neat | Pass | Pass |

Methyl paraben and ethyl paraben are used in lubricating compositions as rust inhibitors. Both samples displayed good physical properties, viscosities and pour points.

EXAMPLES 13 AND 14

Six, 2 lb. batches of Example 13 and one, 2 lb. batch of Example 14 lubricating compositions were formulated by combining the ingredients at 130° F. (54.4° C.) and stirring for 30 minutes.

| | EXAMPLE 1 | EXAMPLE 13 | EXAMPLE 14 |
|---|---|---|---|
| Polyoxy-alkylene glycol[1] | 19.30wt% | 20.32wt% | 18.28wt% |
| Thickener[2] | 0.70 | 0.74 | 0.70 |
| Propylene glycol | 21.70 | 22.84 | 21.70 |
| Ethanol | 5.00 | — | 10.00 |
| Deionized water | 53.21 | 55.68 | 53.21 |
| Ethyl paraben | 0.09 | 0.42 | 0.09 |

[1]TEXOX ® WL-5000, MW 4265
[2]UCON ® 75-H-90000, MW 10,300

The batches were sampled and tested for physical properties.

| | EXAMPLE 1 | EXAMPLE 13 | EXAMPLE 14 |
|---|---|---|---|
| Appearance | Bright, Clear | Bright, Clear | Bright, Clear |
| vis. @ 40° C. | 15.0 cSt | 19.0 cSt | 11.0 cSt |
| Pour Point | −35° F. | −30° F. | — |
| Chip Rust Rest, neat | Pass | Pass | |

An Environmental Study was conducted on the six batches of Example 13. The head space gas over the six batches was sampled. The gas samples were analyzed by gas chromatograph for ethylene oxide, propylene oxide and 1,4-dioxane. The limits of detection were: ethylene oxide 0.1 ppm, propylene oxide 0.1 ppm, and 1,4-dioxane 0.2 ppm.

Results were as follows:

| SAMPLE | ETHYLENE OXIDE | PROPYLENE OXIDE | 1,4-DIOXANE |
|---|---|---|---|
| 13a | 0 | 0.052ppm | 1.083ppm |
| 13b | 0 | 0.053 | 0.544 |
| 13c | 0 | 0.045 | 0.651 |
| 13d | 0 | 0.045 | 0.620 |
| 13e | 0 | 0.043 | 0.486 |
| 13f | 0 | 0.041 | 0.649 |
| TEXOX ® WL-5000 | 0.538ppm | 0.078ppm | 0 |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A method of lubricating the top of a rail comprising:

applying a lubricating composition in an amount sufficient to wet the rail in the heat generated by the passing of a train, the lubricating composition comprising:

15 to 30 wt% propylene glycol;

10 to 30 wt% of a first polyoxyalkylene glycol consisting of a linear ethylene oxide-propylene oxide copolymer having a molecular weight of about 3900 to 4600;

0.1 to 3 wt% of a second polyoxyalkylene glycol consisting of a linear ethylene oxide-propylene oxide copolymer having a molecular weight of 8000 to 12,000; and 2 to 18 wt% of an alcohol selected from the group consisting of ethanol, methanol and mixtures thereof.

2. The method of claim 1 wherein the alcohol is ethanol.

3. The method of claim 1 wherein in the composition, 14 to 24 wt% comprises the first polyoxyalkylene glycol and 3 to 7 wt% comprises the second polyoxyalkylene glycol.

4. The method of claim 1 wherein the amount of lubricating composition is 0.001 to 1.0 gallon/minute.

* * * * *